United States Patent [19]

Sekiyama

[11] Patent Number: 4,872,434

[45] Date of Patent: Oct. 10, 1989

[54] ENGINE BRAKE DEVICE

[75] Inventor: Shigeo Sekiyama, Kawasaki, Japan

[73] Assignee: Isuzu Motors Limited, Tokyo, Japan

[21] Appl. No.: 197,780

[22] Filed: May 23, 1988

[30] Foreign Application Priority Data

May 30, 1987 [JP] Japan ..... 62-136478

[51] Int. Cl.[4] ..... F02D 35/00; F02D 9/06

[52] U.S. Cl. ..... 123/320; 123/323; 188/273; 417/364

[58] Field of Search ..... 123/320, 323; 188/273; 60/624; 417/364

[56] References Cited

U.S. PATENT DOCUMENTS 3,490,567 1/1970 Clark et al. ..... 123/320

4,380,971 4/1983 Tholen et al. ..... 123/323

FOREIGN PATENT DOCUMENTS 1040315 10/1958 Fed. Rep. of Germany ..... 123/323

1807070 5/1970 Fed. Rep. of Germany ..... 123/323

*Primary Examiner*—Andrew M. Dolinar

*Attorney, Agent, or Firm*—Dykema Gossett

[57] ABSTRACT

An engine brake device including a bypass line connecting an inlet line and an exhaust line of an engine so as to guide air from the inlet line to the exhaust line, a compressor rotatably disposed in said bypass line with its output shaft being connected to a crankshaft of the engine and opening-closing device for opening said bypass line upon engine braking.

9 Claims, 1 Drawing Sheet

ENGINE BRAKE DEVICE

BACKGROUND OF THE INVENTION

1. Field of the Invention

This invention is related to a engine brake device which can produce a braking force by the operation of means of a compressor impeller.

2. Background Art

There is a proposed apparatus which produces a braking force by a compressor impeller, entitled "Braking Device For a Vehicle Equipped With An Internal Combustion Engine" (Japanese Utility Model Koho No. 26244/1985).

In the above application, as shown in FIG. 2 of the accompanying drawings, an oil pump d includes a drive shaft c and a drive gear b which engaged with a crank gear a, and a gallery cut valve f is disposed in the outlet conduit e of the oil pump d so as to close the oil passage e. The gallery cut valve f is actuated in synchronism with an exhaust brake pressure bearing means, namely an exhaust brake valve (not shown). In FIG. 2, designates a bypass conduit, "h" an impeller of the oil pump d, and "i" an oil pan. According to this idea, upon exhaust braking, in addition to a braking force by the exhaust valve, there is generated another braking force by the impeller h of the oil pump d. With the outlet conduit e closed by the gallery valve f, the impeller h performs a negative work which serve as as a resistance against the crank gear a of the engine via the gear b. In this operation, however, there are some drawbacks. Namely, during the exhaust braking, since the impeller h of the oil pump d produces a resistance force against the crank gear a, the temperature of the oil in the oil pan i becomes to high. This means that an oil cooler should be provided. Further, this construction basically requires oil, which is not favorable as a retarder. Besides, although bypass line g is provided, while the gallery valve f is being closed, the oil supply to the oil pump d might be insufficient.

SUMMARY OF THE INVENTION

Regarding the drawbacks of the above prior art, the present invention has for its purpose to provide a engine brake device which can produce a braking force by an impeller of a compressor without using oil.

The purpose of this invention is accomplished by an engine brake device which comprises a bypass line connecting an inlet line and an exhaust line of an engine so as to let the intake air flow from the inlet line to the exhaust line, a compressor rotatably supported in the bypass line with its output shaft being connected to a crankshaft of the engine and opening and closing means for opening the bypass line upon engine braking.

DESCRIPTION OF THE PREFERRED EMBODIMENTS

Figure 1:
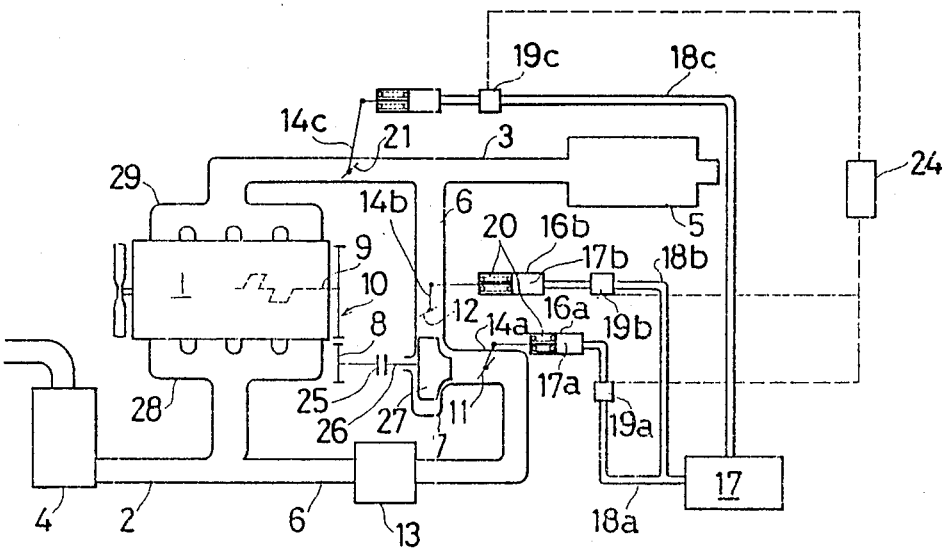
FIG. 1 is a schematic view showing a preferred embodiment of the present invention.
Figure 2:
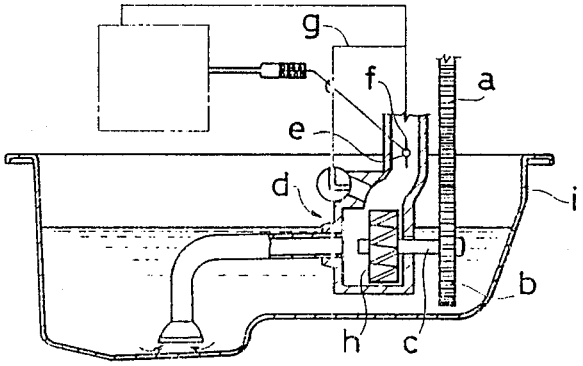
FIG. 2 PRIOR ART
FIG. 2 is a schematic view showing an example of the prior art.

With reference to FIG. 1, a preferred embodiment of this invention will be described in accordance with the accompanying drawings.

In FIG. 1, 1 indicates an engine, 2 an intake air passage connected to the intake manifold 28 of the engine 1, and 3 an exhaust passage connected to the exhaust manifold 29 of the engine 1.

In the upstream of the intake air passage 2, an air cleaner 4 is provided so as to eliminate sand and dust from the air taken in and supply the cleansed air into the engine 1. In the exhaust passage 3, a silencer or muffler 5 is provided so as to suppress the noise downstream thereof.

A bypass line 6 is provided which is branched from the intake air passage 2 downstream of the air cleaner 4 and combined to the exhaust passage 3 just upstream of the silencer 5.

In the bypass line 6, there is disposed a compressor 7 which is rotated by the air flowing in the bypass line 6. This compressor 7 includes an impeller 27 and an output shaft 26. At the end of the output shaft 26 an output gear 8 is fixed. The output shaft 26 has clutch means 25 such as an electromagnetic clutch that disconnects the compressor 7 and the crankshaft 9.

In the bypass line 6 upstream of the compressor 7, there is provided a shut-off valve 11 for opening and closing the bypass line 6, and there is provided a throttling valve 12 for adjusting the magnitude of the section or the flow of air through the bypass line 6. Also, in this embodiment there is provided in the bypass line 6 upstream of the shut-off valve 11 a resonator 13 for reducing the noise upon introducing the air.

The shut-off valve 11 and the throttling valve 12 are respectively actuated by actuators 16*a* and 16*b*, which are driven by the air from an air tank 17, via levers 14*a* and 14*b*. Both of the levers are fixed to the shut-off valve 11 and the throttling valve 12, respectively. 17*a* and 17*b* are action chambers of the actuators 16*a* and 16*b*, respectively, with both chambers being connected to the air tank 17 via air conduits 18*a* and 18*b*. These air conduits 18*a* and 18*b* are switched by electromagnetic valves 19*a* and 19*b*, which have ports (not shown) opening to the external atmosphere, respectively. 20 indicates return springs of the actuators 16*a* and 16*b*. 21 indicates an exhaust brake valve, which is well known in the art, disposed in the exhaust passage 3 upstream of the junction of the bypass line 6 and the exhaust passage 3. The exhaust brake valve 21 is provided in a manner such that when it is actuated, i.e., when it is fully closed, the exhaust pressure is raised, which exerts a braking effort against the engine. The exhaust brake valve 21 is driven via a lever 14*c* by the air which is controlled from an air tank 16 supplied through the air conduit 18*c*, which has an electromagnetic valve 19*c*.

The electromagnetic valves 19*a*, 19*b* and 19*c* are all electrically connected to opening-closing means 24, in a manner such that the electromagnetic valves 19*a* and 19*b* are turned ON upon exhaust braking.

During normal driving, namely driving without exhaust braking, the electromagnetic valve 19*a* is OFF, the shut-off valve 11 closes the bypass line 6, and the air cleansed by the air cleaner 4 is introduced through the intake air passage 2 into the engine 1 and discharged to atmosphere through the exhaust passage 3 via the silencer 5. At this time, the clutch means 25 of the output shaft 26 does not connect the compressor 7 and the crankshaft 9, and hence the compressor 7 does not perform any work against the engine.

During the exhaust braking, on the other hand, the electromagnetic valves 19*a* and 19*b* are turned ON, actuating the actuators 16*a* and 16*b*, so that the shut-off valve 11 opens the bypass line 6, and at the same time the throttling valve 12 is moved to an optimum position. Said clutch means 25, this time, connects the compressor 7 and the crankshaft 9 via the gear train 10. Therefore, when the compressor 7 discharges the air induced through the bypass line 6, the compressor 7 substantially works at low efficiency, imposing large negative work on the crankshaft 9. Hence, a desired braking effort is acquired. The air compressed by the compressor 7 has passed through the air cleaner 4 so that obstacles which might break the compressor 7 have been eliminated. Additionally, since the resonator 13 and the silencer 5 are disposed in the bypass line 6 and the exhaust line 3 respectively as noise eliminators, noise is not produced upon engine braking.

As should be apparent, the shut-off valve 11 may be located at the entrance of the housing of the compressor 7 and the throttling valve 12 at the exit thereof. Further, the throttling valve 12 can be replaced by a movable nozzle vane which changes the sectional magnitude of the throat of the compressor 7.

What is claimed is:

1. An engine brake device for use on an engine having an inlet line and an exhaust line, said brake device comprising:

a bypass line interconnecting said inlet line and said exhaust line permitting intake air to flow from said inlet line to said exhaust line;

a compressor having an output shaft, said compressor rotatably disposed in said bypass line with said output shaft connected to said engine; and opening and closing means operatively mounted within said bypass line for controlling the flow of air through said bypass line upon braking said engine such that said compressor discharges air induced through said bypass line imposing large negative work on said engine.

2. The engine brake device of claim 1 further including an air cleaner upstream of said compressor.

3. The engine brake device of claim 1 further including a muffler in said exhaust line downstream of said bypass line.

4. The engine brake device of claim 1, wherein said opening and closing means includes a throttle valve to adjust the flow path through said bypass line.

5. The engine brake device of claim 4 wherein a shut-off valve is disposed in said bypass line upstream of said compressor and said throttle valve is disposed in said bypass line downstream of said compressor.

6. The engine brake device of claim 1, wherein said output shaft of said compressor is connected to the crankshaft of said engine through a gear train.

7. The engine brake device of claim 1, wherein said output shaft of said compressor is connected to said engine through a clutch means.

8. The engine brake device of claim 1 further including a muffler in said bypass line upstream of said compressor.

9. A brake device for use on an engine having a crankshaft, an air inlet line and an exhaust line, said brake device comprising:

a bypass line connecting said inlet line and said exhaust line for communicating air from said inlet line to said exhaust line;

a compressor rotatably disposed in said bypass line, said compressor having an output shaft connected to said crankshaft of said engine;

opening and closing means for selectively controlling the flow of air through said bypass line;

an exhaust brake valve disposed in said exhaust line upstream of said bypass line to selectively throttle said exhaust line; and control means for controlling said opening and closing means synchronously with said exhaust brake valve to generate a braking force.

* * * * *